US012781319B2

(12) United States Patent
Tani et al.

(10) Patent No.: US 12,781,319 B2
(45) **Date of Patent: *Nov. 3, 2026**

(54) METHOD FOR PRODUCING GRAIN-ORIENTED ELECTRICAL STEEL SHEET

(71) Applicant: JFE Steel Corporation, Tokyo (JP)

(72) Inventors: Ryosuke Tani, Tokyo (JP); Takeshi Imamura, Tokyo (JP); Shigehiro Takajo, Tokyo (JP); Hiroi Yamaguchi, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 396 days.

This patent is subject to a terminal disclaimer.

(21) Appl. No.: 18/284,334

(22) PCT Filed: Mar. 28, 2022

(86) PCT No.: PCT/JP2022/014908

§ 371 (c)(1),
(2) Date: Sep. 27, 2023

(87) PCT Pub. No.: WO2022/210504

PCT Pub. Date: Oct. 6, 2022

(65) Prior Publication Data

US 2024/0150875 A1 May 9, 2024

(30) Foreign Application Priority Data

Mar. 31, 2021 (JP) ..... 2021-060885

(51) Int. Cl.

| | |
|---|---|
| ***C22C 38/02*** | (2006.01) |
| ***C21D 6/00*** | (2006.01) |
| ***C21D 8/1216*** | (2026.01) |
| ***C21D 8/1244*** | (2026.01) |
| ***C21D 8/1277*** | (2026.01) |
| ***C21D 9/46*** | (2006.01) |
| ***C22C 38/00*** | (2006.01) |
| ***C22C 38/04*** | (2006.01) |
| ***C22C 38/06*** | (2006.01) |

(52) U.S. Cl.

CPC ..... *C22C 38/02* (2013.01); *C21D 6/008* (2013.01); *C21D 8/1222* (2013.01); *C21D 8/1233* (2013.01); *C21D 8/1261* (2013.01); *C21D 8/1272* (2013.01); *C21D 8/1283* (2013.01); *C21D 9/46* (2013.01); *C22C 38/001* (2013.01); *C22C 38/04* (2013.01); *C22C 38/06* (2013.01); *C21D 2201/05* (2013.01)

(58) Field of Classification Search

CPC ..... H01F 1/14783; H01F 1/18; Y02P 10/20; C21D 2201/05; C21D 6/008; C21D 8/1222; C21D 8/1233; C21D 8/1272; C21D 8/1261; C21D 8/1283; C21D 9/46; C22C 38/02; C22C 38/06; C22C 38/60; C22C 38/001

See application file for complete search history.

(56) References Cited

U.S. PATENT DOCUMENTS

| | | | | |
|---|---|---|---|---|
| 3,932,234 | A | 1/1976 | Imanaka et al. | |
| 4,979,997 | A | 12/1990 | Kobayashi et al. | |
| 12,291,758 | B2 * | 5/2025 | Ehashi | C22C 38/20 |
| 12,305,255 | B2 * | 5/2025 | Ehashi | C21D 6/002 |
| 2013/0017408 | A1 * | 1/2013 | Sakai | C21D 8/1294 219/121.72 |
| 2016/0012949 | A1 | 1/2016 | Uesaka et al. | |
| 2016/0319390 | A1 * | 11/2016 | Imamura | C21D 6/004 |
| 2019/0233914 | A1 * | 8/2019 | Hayakawa | C21D 9/46 |
| 2022/0042137 | A1 | 2/2022 | Ehashi et al. | |
| 2022/0195555 | A1 | 6/2022 | Ehashi et al. | |

(Continued)

FOREIGN PATENT DOCUMENTS

| | | |
|---|---|---|
| CN | 105008557 A | 10/2015 |
| EP | 3 960 887 A1 | 3/2022 |
| EP | 3 960 888 A1 | 3/2022 |

(Continued)

OTHER PUBLICATIONS

International Search Report and Written Opinion for International Application No. PCT/JP2022/014908, dated Jun. 7, 2022, 7 pages.

Japanese Concise Statement of Relevance of Office Action for Japanese Application No. JP2022-541800, dated Aug. 8, 2023, with partial English translation, 8 pages.

Office Action (The First Office Action) issued May 15, 2025, by the State Intellectual Property Office of People's Republic of China in corresponding Chinese Patent Application No. 202280024766.6 and an English translation of the Office Action. (18 pages).

(Continued)

*Primary Examiner* — Jie Yang

(74) *Attorney, Agent, or Firm* — Buchanan Ingersoll & Rooney PC

(57) ABSTRACT

Proposed is a method for producing a grain-oriented electrical steel sheet that comprises heating a steel material containing a certain composition and inhibitor-forming ingredients to a temperature in a range of 1300 to 1400° C.; performing hot rolling, hot-band annealing, and cold rolling on the material to obtain a cold-rolled sheet; performing decarburization annealing also serving as primary recrystallization annealing on the cold-rolled sheet; subsequently applying an annealing separator to a surface of the steel sheet; and performing finishing annealing followed by applying an insulation coating. In the method, rapid heating is conducted from 500 and 700° C. in a heating process of the decarburization annealing at a rate of 100 to 1000° C./s while gradual heating is conducted from 860 to 970° C. in a heating process of the finishing annealing at a heating rate of 0.5 to 4.0° C./hr for at least 10 hours.

7 Claims, No Drawings

(56) References Cited

U.S. PATENT DOCUMENTS

2024/0183011 A1* 6/2024 Tani ..... C21D 8/1233

FOREIGN PATENT DOCUMENTS

| | | | |
|---|---|---|---|
| JP | 4015644 | | 4/1963 |
| JP | 388214 | | 6/1963 |
| JP | 5113469 | B2 | 4/1976 |
| JP | 5224116 | A | 2/1977 |
| JP | 58193373 | A | 11/1983 |
| JP | 59190325 | A | 10/1984 |
| JP | 032324 | A | 1/1991 |
| JP | 04272166 | A | 9/1992 |
| JP | 0762436 | A | 3/1995 |
| JP | 10130729 | A | 5/1998 |
| JP | 2000129356 | A | 5/2000 |
| JP | 2019163518 | A | 9/2019 |
| WO | 2014132930 | A1 | 9/2014 |
| WO | 2020/218328 | A1 | 10/2020 |
| WO | 2020218329 | A1 | 10/2020 |

OTHER PUBLICATIONS

Extended European Search Report issued May 28, 2025, by the European Patent Office in corresponding European Patent Application No. 22780715.3-1103. (11 pages).

* cited by examiner

METHOD FOR PRODUCING GRAIN-ORIENTED ELECTRICAL STEEL SHEET

CROSS REFERENCE TO RELATED APPLICATIONS

This is the U.S. National Phase application of PCT/JP2022/014908, filed Mar. 28, 2022, which claims priority to Japanese Patent Application No. 2021-060885, filed Mar. 31, 2021, the disclosures of these applications being incorporated herein by reference in their entireties for all purposes.

FIELD OF THE INVENTION

The present invention is related to a method for producing a grain-oriented electrical steel sheet with low iron loss and high magnetic flux density.

BACKGROUND OF THE INVENTION

Grain-oriented electrical steel sheets are soft magnetic materials used as a material for an iron core of a transformer or a power generator. A characteristic thereof lies in having a crystal texture in which the <001> orientation, which is a magnetic easy axis of iron, is highly aligned along a rolling direction of the steel sheet. Such a texture is formed by developing a secondary recrystallization during finishing annealing in production steps of a grain-oriented electrical steel sheet and preferentially growing crystal grains having the {110} <001> orientation called the Goss orientation, to be ultra large grains.

To develop the secondary recrystallization, a technique employing fine precipitates called an inhibitor is widely used. For example, Patent Literature 1 discloses a method using MnS or MnSe as an inhibitor, and Patent Literature 2 discloses a method using AlN or MnS as an inhibitor, both of which have industrially been put into practical use. Although requiring heating a slab to such an extremely high temperature as 1300° C. or higher, these methods using the inhibitors are very effective for stably realizing the secondary recrystallization. (worst) magnetic flux density value were used as representative values of the coil product. As seen from Table 1 showing the measurement results, when the heating rate between 500° C. and 700° C. in the heating process of decarburization annealing is 200° C./s, the iron loss value tends to increase, while the magnetic flux density tends to decrease, compared to a case using a heating rate of 30° C./s.

TABLE 1

| No. | HEATING RATE IN DECARBURIZATION ANNEALING (° C./s) | MAGNETIC PROPERTIES: IRON LOSS $W_{17/50}$ (W/kg) | MAGNETIC PROPERTIES: MAGNETIC FLUX DENSITY $B_8$ (T) |
|---|---|---|---|
| 1 | 30 | 0.85 | 1.93 |
| 2 | 200 | 0.84 | 1.92 |

In this background, we conducted another experiment where the heating rate between 500° C. and 700° C. in the heating process of the decarburization annealing was set to 200° C./s (constant) and where the heating rate between 860° C. and 970° C. in the heating process of the finishing annealing was varied as shown in Table 2 to measure iron loss $W_{17/50}$ and magnetic flux density $B_8$ in the same manner as above. Table 2 below shows the measurement results. As seen from the results, there exists an optimal range of the heating rate for the finishing annealing that can achieve both low iron loss and high magnetic flux density, and specifically, it is the range of 0.5° C./hr to 4.0° C./hr.

TABLE 2

| No. | HEATING RATE CONTROL RANGES IN FINISHING ANNEALING: TEMPERATURE RANGE (° C.) | HEATING RATE (° C./hr) | MAGNETIC PROPERTIES: IRON LOSS $W_{17/50}$ (W/kg) | MAGNETIC PROPERTIES: MAGNETIC FLUX DENSITY $B_8$ (T) |
|---|---|---|---|---|
| 1 | 860 to 970 | 0.5 | 0.81 | 1.93 |
| 2 | 880 to 940 | 0.2 | 0.84 | 1.92 |
| 3 | 880 to 940 | 0.5 | 0.82 | 1.93 |
| 4 | 880 to 940 | 1.5 | 0.81 | 1.94 |
| 5 | 880 to 940 | 3.5 | 0.82 | 1.93 |
| 6 | 880 to 940 | 8.0 | 0.87 | 1.91 |

As explained above, properly setting the heating rate between 86° and 970° C. in the finishing annealing can achieve the iron loss reduction effect caused by the rapid heating in the decarburization annealing, without reducing the magnetic flux density. Although the reason has not yet sufficiently been revealed, the present inventors consider it as follows.

Increasing the heating rate in the decarburization annealing causes more recrystallized grains of the Goss orientation of the primary recrystallization texture and those in the vicinity. Thus, the increased primary recrystallized grains of the Goss orientation and those in the vicinity develop secondary recrystallization in the finishing annealing, forming a secondary recrystallization texture with finer grains. When the steel sheet is gradually heated in the temperature range of 860 to 970° C. at 0.5 to 4.0° C./hr, as proposed in accordance with aspects of the present invention, the grain growth of the grains of the Goss orientation becomes predominant over that of the grains in the vicinity, increasing the orientation sharpness of the secondary recrystallization texture and the magnetic flux density $B_8$. In contrast, when the heating rate is less than 0.5° C./hr, the difference in the grain growth between the grains of the Goss orientation and those in the vicinity becomes smaller, lowering the orientation sharpness of the secondary recrystallization texture. When the heating rate is more than 4.0° C./hr, the growth speeds of the grains of the Goss orientation and those in the vicinity increase significantly, presumably lowering the orientation sharpness of the secondary recrystallization texture.

Aspects of the present invention were developed on the basis of the novel discovery described above.

Next, a component composition of a steel material (slab) used for producing a grain-oriented electrical steel sheet according to aspects of the present invention will be explained.

C: 0.002 to 0.10 Mass %

When C is contained by less than 0.002 mass %, a grain boundary strengthening effect by C hardly works, causing cracks in the slab, which may lead to a production failure or a surface defect. Whereas, when C is contained by more than 0.10 mass %, it is difficult to reduce C to 0.005 mass % or lower by which magnetic aging is prevented in the decarburization annealing. Accordingly, the C content falls within the range of 0.002 to 0.10 mass %, preferably 0.010 to 0.080 mass %.

Si: 2.0 to 8.0 Mass %

Si is a requisite component for enhancing the specific resistance of steel and reducing iron loss. The Si content of less than 2.0 mass % hardly achieves the above effect sufficiently, while the Si content exceeding 8.0 mass % causes the lowering of the workability to make rolling difficult. Accordingly, the Si content falls within the range of 2.0 mass % to 8.0 mass %, preferably 2.5 to 4.5 mass %.

Mn: 0.005 to 1.0 Mass %

Mn improves the hot workability of steel and needs to be contained by 0.005 mass % or more. When the Mn content exceeds 1.0 mass %, the magnetic flux density of a product sheet starts to lower. Accordingly, the Mn content falls within the range of 0.005 to 1.0 mass %, preferably 0.02 to 0.20 mass %.

An inhibitor-forming ingredient needs to be contained to develop secondary recrystallization in finishing annealing, other than C, Si, and Mn. More specifically, when an AlN-based inhibitor is used as the inhibitor, Al: 0.010 to 0.050 mass % and N: 0.003 to 0.020 mass %, preferably Al: 0.013 to 0.025 mass % and N: 0.005 to 0.010 mass % need to be contained. Further, an AlN-based inhibitor and an MnS·MnSe-based inhibitor can be used together, where Al: 0.010 to 0.050 mass %, N: 0.003 to 0.020 mass %, and at least one of S: 0.002 to 0.030 mass % and Se: 0.003 to 0.030 mass %, preferably Al: 0.013 to 0.025 mass %, N: 0.005 to 0.010 mass %, and at least one of S: 0.004 to 0.015 mass % and Se: 0.005 to 0.020 mass % are inevitably contained. When each content is smaller than the abovementioned lower limit value, the effect of the inhibitor cannot be obtained sufficiently while when each content exceeds the abovementioned upper limit value, the inhibitor-forming ingredients remain undissolved at slab heating to deteriorate the inhibitor effect, resulting in unstable secondary recrystallization and insufficient iron loss properties.

The steel material used in accordance with aspects of the present invention contains Fe and inevitable impurities as the remaining part other than the abovementioned ingredients. To improve the iron loss properties, the steel material may further contain, in addition to the above-described ingredients, one or more selected as appropriate from the group consisting of Ni: 0.01 to 1.50 mass %, Cr: 0.01 to 0.50 mass %, Cu: 0.005 to 1.000 mass %, P: 0.005 to 0.500 mass %, Sb: 0.005 to 0.500 mass %, Sn: 0.005 to 0.500 mass %, Bi: 0.005 to 0.500 mass %, Mo: 0.005 to 0.500 mass %, Nb: 0.0010 to 0.0100 mass %, Ta: 0.001 to 0.010 mass %, and Ti: 0.001 to 0.0100 mass %.

Next, a method for producing a grain-oriented electrical steel sheet according to aspects of the present invention will be explained.

The method for producing a grain-oriented electrical steel sheet according to aspects of the present invention includes a series of steps: heating a steel material (slab) having the component composition described above to a prescribed temperature; hot rolling the slab to form a hot-rolled sheet; subjecting the hot-rolled sheet to hot-band annealing and then to one cold rolling or to two or more cold rollings with intermediate annealing between each cold rolling to form a cold-rolled sheet with a final sheet thickness; subjecting the cold-rolled sheet to decarburization annealing also serving as primary recrystallization annealing; applying an annealing separator to the surface of the steel sheet; subjecting the steel sheet to finishing annealing followed by forming an insulation coating. The procedure will be explained more specifically below.

The steel material (slab) is preferably produced by preparing steel adjusted to have the component composition described above through a commonly-known refining process followed by melting and conducting a continuous casting method or an ingot casting/slab rolling method. Alternatively, it is also acceptable to produce a thin slab having a thickness of 100 mm or less by implementing a direct casting method.

The steel slab is then heated to a temperature between 130° and 1400° C. and hot rolled. When the slab heating temperature is lower than 1300° C., an inhibitor-forming ingredient remains undissolved, causing unstable secondary recrystallization and/or insufficient magnetic properties. Whereas, the slab heating temperature exceeding 1400° C. brings about an increase in scale loss and/or a surface defect. Thus, the heating temperature preferably falls within the range of 1310 to 1375° C. The hot rolling condition can be an ordinary hot rolling condition for a grain-oriented electrical steel sheet and are not particularly limited. When using a thin slab, the hot rolling may be omitted.

The hot-rolled sheet resulting from the hot rolling is then subjected to hot-band annealing to improve magnetic properties. The hot-band annealing is performed under commonly-known conditions and is not particularly limited.

The hot-rolled sheet after the hot-band annealing is subjected to descaling by pickling and to commonly-known one cold rolling or two or more cold rollings with intermediate annealing between each cold rolling to form a cold-rolled sheet having a final sheet thickness (a product sheet thickness).

The cold-rolled sheet having the final sheet thickness is then subjected to decarburization annealing also serving as primary recrystallization annealing to thus obtain a desired primary recrystallization texture as well as to reduce the C content in the steel sheet to 0.0050 mass % or lower by which magnetic aging is prevented. In this case, it is important to conduct rapid heating in the temperature range from 500 to 700° C. in the heating process of the decarburization annealing at a heating rate of 100 to 1000° C./s to improve the primary recrystallization texture and form finer secondary recrystallized grains. With the heating rate being lower than 100° C./s, the number of grains of the Goss orientation, which serve as a core of the secondary recrystallization, contained in the primary recrystallization texture would decrease. Whereas, the heating rate exceeding 1000° C./s would increase the number of crystal grains other than those of the Goss orientation. In both cases, the magnetic properties would be degraded. The heating rate is preferably in the range of 150 to 700° C./s. From the aspect of promoting decarburization, a preferable soaking condition for the decarburization annealing is in the range of 800 to 900° C. for 60 to 300 s in a wet atmosphere.

The steel sheet resulting from the decarburization annealing is coated with an annealing separator on the surface, dried, and wound into a coil form. The coil-formed steel sheet is directly subjected to finishing annealing to cause secondary recrystallization. It is essential to gradually heat the steel sheet in the range of 860 to 970° C. in the heating process of the finishing annealing at 0.5° to 4.0° C./hr to allow the crystal grains of the Goss orientation to preferentially grow, preventing an increase in the secondary crystal grains other than those of the Goss orientation. This is because, with the heating rate being lower than 0.5° C./hr, the orientation sharpness of the Goss orientation in the secondary recrystallization texture would deteriorate while the heating rate exceeding 4.0° C./hr would excessively increase the growth speeds of grains of the Goss orientation and those in the vicinity, leading to a significant decrease in an accumulation degree of the secondary recrystallized grains toward the Goss orientation. The heating rate preferably falls within the range of 0.7 to 2.0° C./hr. To achieve the abovementioned effects, the period for conducting the gradual heating at 0.5 to 4.0° C./hr should be 10 hours or longer, preferably 20 hours or longer. As long as the gradual heating can be performed for 10 hours or longer, the range for the gradual heating may be a part of the temperature range between 860 and 970° C., the atmosphere for which is preferably nitrogen, argon, or a mixed atmosphere of nitrogen and argon.

Subsequent to the gradual heating, the steel sheet is heated to a temperature from 1150 to 1250° C. and held at the temperature for 5 to 20 hours for purification to eliminate impurities in the steel sheet. This treatment can reduce the inhibitor-forming ingredients such as Al, N, S, and Se in the steel sheet to a level of impurities. The atmosphere in the purification is preferably hydrogen and may use nitrogen or argon as necessary. The heating rate to reach the purification temperature is preferably 5° C./hr or more, where the atmosphere may be nitrogen, argon, a mixed atmosphere of nitrogen and hydrogen, or a mixed atmosphere of argon and hydrogen.

After unreacted annealing separator is removed from the surface, the steel sheet after the finishing annealing is subjected to flattening annealing and coated with an insulation coating to produce a product sheet. To reduce iron loss, the insulation coating is preferably a tension-imparting type.

To further reduce the iron loss, magnetic domain subdividing treatment is preferably conducted on the grain-oriented electrical steel sheet according to aspects of the present invention. The magnetic domain subdividing treatment can use such a commonly-known method as a method of forming grooves by etching the surface of the steel sheet continuously or intermittently in the direction intersecting the rolling direction and also at prescribed intervals in the rolling direction in any step after the cold rolling and another method of eradiating a laser beam or electron beam onto the surface of the steel sheet having the insulation coating formed thereon continuously or intermittently in the direction intersecting the rolling direction and also at prescribed intervals in the rolling direction.

EXAMPLE 1

A steel slab was prepared by a continuous casting method to have a component composition containing C: 0.004 mass %, Si: 4.2 mass %, and Mn: 0.23 mass % and also containing Al: 0.015 mass %, N: 0.005 mass %, Se: 0.004 mass %, and S: 0.005 mass % with the remaining part containing Fe and inevitable impurities. The slab was heated to 1350° C. and hot-rolled to form a hot-rolled sheet with a sheet thickness of 2.4 mm. The hot-rolled sheet was subjected to hot-band annealing at 1100° C. for 30 seconds, to cold rolling for the first time to achieve an intermediate sheet thickness of 1.8 mm, to intermediate annealing at 1020° C. for 100 seconds, and to cold rolling for the second time by using a reverse roller to form a cold-rolled sheet with a final sheet thickness of 0.23 mm. The cold-rolled sheet was subjected to decarburization annealing also serving as primary recrystallization annealing at 880° C. for 60 seconds in a wet atmosphere of 50 vol % $H_2$ and 50 vol % $N_2$, where the heating rate between 50° and 700° C. in the heating process was set 700° C./s. Subsequently, an annealing separator mainly composed of MgO was applied to the surface of the steel sheet. The steel sheet was then wound into a coil form and subjected to finishing annealing. The heating condition and the annealing atmosphere between 86° and 970° C. in the heating process of the finishing annealing were varied as shown in Table 3.

Test specimens were taken from the steel sheet resulting from the finishing annealing to measure iron loss $W_{17/50}$ (iron loss exhibited from 1.7 T excitation at a frequency of 50 Hz) and magnetic flux density $B_8$ (magnetic flux density exhibited from magnetic force of 800 A/m) according to the method defined by JIS C 2550. The test specimens were taken from three locations, both end parts and a central part of the produced coil. The highest (worst) iron loss value and the lowest (worst) magnetic flux density value were used as representative values of the coil. Table 3 below shows the measurement results. These results show that steel sheets with low iron loss and high magnetic flux density were obtained when the heating rate from 860 to 970° C. in the finishing annealing was in the range of 0.5 to 4.0° C./hr.

TABLE 3

| | FINISHING ANNEALING CONDITIONS | | | | MAGNETIC PROPERTIES | |
|---|---|---|---|---|---|---|
| No. | GRADUAL HEATING RANGE (° C.) | HEATING RATE IN GRADUAL HEATING RANGE (° C./hr) | HEATING RATE GRADUAL OUTSIDE HEATING RANGE (° C./hr) | ANNEALING ATMOSPHERE BETWEEN 860° C. AND 970° C. | IRON LOSS $W_{17/50}$ (W/kg) | MAGNETIC FLUX DENSITY $B_8$ (T) |
| 1 | 900 to 960 | 0.3 | 15 | $N_2$ | 0.82 | 1.92 |
| 2 | 900 to 960 | 0.5 | 15 | $N_2$ | 0.82 | 1.93 |
| 3 | 900 to 960 | 1.5 | 15 | $N_2$ | 0.81 | 1.94 |
| 3 | 900 to 960 | 2.5 | 15 | $N_2$ | 0.82 | 1.94 |
| 5 | 900 to 960 | 3.5 | 15 | $N_2$ | 0.82 | 1.94 |
| 6 | 900 to 960 | 4.0 | 15 | $N_2$ | 0.82 | 1.94 |
| 7 | 900 to 960 | 4.5 | 15 | $N_2$ | 0.85 | 1.92 |
| 8 | 900 to 960 | 5.0 | 15 | $N_2$ | 0.88 | 1.86 |
| 9 | 860 to 970 | 2.5 | — | $N_2$ | 0.82 | 1.94 |
| 10 | 860 to 970 | 2.5 | — | Ar | 0.82 | 1.94 |

EXAMPLE 2

Steel slabs with the various component compositions shown in Table 4 were produced by a continuous casting method. The slab was heated to 1200° C. and hot-rolled to form a hot-rolled sheet with a sheet thickness of 2.4 mm. The hot-rolled sheet is subject to hot-band annealing at 1100° C. for 30 seconds, to cold rolling for the first time to have a cold-rolled sheet with a final sheet thickness of 0.23 mm, and to decarburization annealing also serving as primary recrystallization annealing at 880° C. for 60 seconds in a wet atmosphere of 50 vol % $H_2$ and 50 vol % $N_2$. The heating rate between 500° C. and 700° C. in the heating process was set 300° C./s. Subsequently, an annealing separator mainly composed of MgO was applied to the surface of the steel sheet. The steel sheet was wound in a coil form and subjected to finishing annealing, where the sheet was gradually heated from 860 to 970° C. in an $N_2$ atmosphere at a heating rate of 1.0° C./hr between 880 and 940° C. for 60 hours and at a heating rate of 15° C./hr in the other temperature ranges. The steel sheet was heated to 1180° C. at 25° C./hr in a mixed atmosphere of $H_2$: 75 vol % and $N_2$: 25 vol % and held at the temperature for 30 hours in an $H_2$ atmosphere to conduct purification.

TABLE 4

| STEEL SHEET | COMPONENT COMPOSITION (mass %) | | | | | | | | | | | |
|---|---|---|---|---|---|---|---|---|---|---|---|---|
| No. | C | Si | Mn | sol. Al | N | S | Se | Sb | Sn | Mo | P | OTHERS |
| 1 | 0.063 | 2.14 | 0.064 | 0.0168 | 0.0061 | 0.0025 | 0.0089 | — | — | — | — | — |
| 2 | 0.047 | 3.41 | 1.15 | 0.0152 | 0.0048 | 0.0034 | 0.0065 | 0.155 | — | — | — | — |
| 3 | 0.166 | 3.70 | 0.072 | 0.0180 | 0.0120 | 0.0017 | 0.0084 | — | — | — | — | — |
| 4 | 0.052 | 3.44 | 0.088 | 0.0172 | 0.0229 | 0.0006 | 0.0076 | — | — | — | — | — |
| 5 | 0.038 | 3.38 | 0.069 | 0.0186 | 0.0062 | 0.0328 | 0.0044 | 0.073 | — | — | — | — |
| 6 | 0.047 | 3.52 | 0.071 | 0.0148 | 0.0045 | 0.0019 | 0.032 | 0.050 | — | — | — | — |
| 7 | 0.056 | 3.30 | 0.063 | 0.0512 | 0.0090 | 0.0010 | 0.0092 | — | — | — | — | — |
| 8 | 0.038 | 3.40 | 0.072 | 0.0188 | 0.0082 | 0.0017 | 0.0065 | — | — | — | — | — |
| 9 | 0.055 | 3.39 | 0.062 | 0.0163 | 0.0070 | 0.0021 | 0.0083 | 0.072 | — | 0.029 | — | — |
| 10 | 0.047 | 3.18 | 0.081 | 0.0192 | 0.0062 | 0.0026 | 0.0066 | 0.038 | 0.04 | — | — | — |
| 11 | 0.070 | 3.29 | 0.070 | 0.0165 | 0.0047 | 0.0022 | 0.0098 | 0.050 | — | — | 0.043 | — |
| 12 | 0.052 | 3.34 | 0.052 | 0.0187 | 0.0102 | 0.0024 | 0.0052 | 0.023 | — | 0.018 | 0.039 | — |
| 13 | 0.049 | 3.20 | 0.071 | 0.0175 | 0.0042 | 0.0034 | 0.0058 | 0.048 | — | 0.037 | 0.042 | — |
| 14 | 0.045 | 3.21 | 0.067 | 0.0208 | 0.0077 | 0.0010 | 0.0088 | 0.050 | — | 0.019 | 0.038 | Cr: 0.05 |
| 15 | 0.040 | 2.90 | 0.082 | 0.0187 | 0.0088 | 0.0020 | 0.0077 | 0.114 | — | 0.033 | 0.026 | Ti: 0.0011 |
| 16 | 0.052 | 3.24 | 0.072 | 0.0211 | 0.0079 | 0.0014 | 0.0051 | 0.044 | — | — | — | Ni: 0.05 |
| 17 | 0.046 | 3.23 | 0.082 | 0.0235 | 0.0082 | 0.0013 | — | 0.033 | — | 0.012 | — | Cu: 0.02 |
| 18 | 0.043 | 3.15 | 0.062 | 0.0192 | 0.0074 | 0.0012 | 0.0032 | 0.026 | 0.02 | 0.019 | — | Bi: 0.0005 |
| 19 | 0.048 | 3.19 | 0.071 | 0.0242 | 0.0069 | 0.0011 | 0.0035 | 0.034 | — | 0.013 | — | Nb: 0.0012 |
| 20 | 0.062 | 3.18 | 0.079 | 0.0222 | 0.0081 | 0.0013 | 0.0055 | 0.039 | — | 0.014 | — | Ta: 0.0014 |
| 21 | 0.048 | 3.25 | 0.077 | 0.0232 | 0.0081 | 0.0011 | — | 0.012 | 0.05 | 0.013 | 0.022 | — |

| STEEL SHEET No. | MAGNETIC PROPERTIES: IRON LOSS $W_{17/50}$ (W/kg) | MAGNETIC FLUX DENSITY $B_8$ (T) | NOTES |
|---|---|---|---|
| 1 | 2.44 | 1.55 | COMPARATIVE EXAMPLE |
| 2 | 2.87 | 1.54 | COMPARATIVE EXAMPLE |
| 3 | 2.44 | 1.56 | COMPARATIVE EXAMPLE |
| 4 | 2.88 | 1.57 | COMPARATIVE EXAMPLE |
| 5 | 1.55 | 1.54 | COMPARATIVE EXAMPLE |
| 6 | 2.32 | 1.55 | COMPARATIVE EXAMPLE |
| 7 | 2.55 | 1.56 | COMPARATIVE EXAMPLE |
| 8 | 0.82 | 1.93 | INVENTION EXAMPLE |
| 9 | 0.82 | 1.94 | INVENTION EXAMPLE |
| 10 | 0.81 | 1.94 | INVENTION EXAMPLE |
| 11 | 0.81 | 1.94 | INVENTION EXAMPLE |
| 12 | 0.82 | 1.94 | INVENTION EXAMPLE |
| 13 | 0.81 | 1.94 | INVENTION EXAMPLE |
| 14 | 0.82 | 1.94 | INVENTION EXAMPLE |
| 15 | 0.81 | 1.94 | INVENTION EXAMPLE |
| 16 | 0.82 | 1.94 | INVENTION EXAMPLE |
| 17 | 0.81 | 1.94 | INVENTION EXAMPLE |
| 18 | 0.81 | 1.94 | INVENTION EXAMPLE |
| 19 | 0.81 | 1.95 | INVENTION EXAMPLE |
| 20 | 0.81 | 1.95 | INVENTION EXAMPLE |
| 21 | 0.81 | 1.94 | INVENTION EXAMPLE |

Test specimens were taken from the steel sheet resulting from the finishing annealing to measure iron loss $W_{17/50}$ (iron loss exhibited from 1.7 T excitation at a frequency of 50 Hz) and magnetic flux density Bs (magnetic flux density exhibited from magnetic force of 800 A/m) according to the method defined by JIS C 2550. The test specimens were taken from three locations, both end parts and a central part of the produced coil. The highest (worst) iron loss value and the lowest (worst) magnetic flux density value were used as representative values of the coil. Table 4 shows the measurement results. Those results show that grain-oriented electrical steel sheets with low iron loss and high magnetic flux density can be obtained by using steel materials satisfying aspects of the present invention and applying the conditions compliant with aspects of the present invention.

The invention claimed is:

1. A method for producing a grain-oriented electrical steel sheet comprising preparing a steel material having a component composition containing C: 0.002 to 0.10 mass %, Si: 2.0 to 8.0 mass %, and Mn: 0.005 to 1.0 mass % and further containing, as inhibitor-forming ingredients, ingredients in one of Groups A and B:

Group A: Al: 0.010 to 0.050 mass % and N: 0.003 to 0.020 mass %;

Group B: Al: 0.010 to 0.050 mass %, N: 0.003 to 0.020 mass %, and at least one of Se: 0.003 to 0.030 mass % and S: 0.002 to 0.030 mass %, and a remaining part being Fe and inevitable impurities;

heating the steel material to a temperature in the range of 1310 to 1400° C.;

hot rolling the steel material to form a hot-rolled sheet;

subjecting the hot-rolled sheet to hot-band annealing and then to one cold rolling or two or more cold rollings with intermediate annealing between each rolling to form a cold-rolled sheet with a final sheet thickness;

subjecting the cold-rolled sheet to decarburization annealing serving as primary recrystallization annealing;

applying an annealing separator to the surface of the steel sheet; and subjecting the steel sheet to finishing annealing followed by a formation of an insulation coating in order to produce the grain-oriented electrical steel sheet, the grain-oriented steel sheet having an iron loss $W_{17/50}$ of 0.82 or less in combination with a magnetic flux density $B_8$(T) of 1.93 or more, characterized in that rapid heating is conducted from 500 to 700° C. in the heating process of the decarburization annealing at a rate of 100 to 1000° C./s while gradual heating is conducted from 860 to 970° C. in a heating process of the finishing annealing at a heating rate of 0.5 to 4.0° C./hr for at least 10 hours.

2. The method for producing a grain-oriented electrical steel sheet according to claim 1, wherein the steel material contains, in addition to the above component composition, at least one selected from the group consisting of: Ni: 0.01 to 1.50 mass %, Cr: 0.01 to 0.50 mass %, Cu: 0.005 to 1.000 mass %, P: 0.005 to 0.500 mass %, Sb: 0.005 to 0.500 mass %, Sn: 0.005 to 0.500 mass %, Bi: 0.005 to 0.500 mass %, Mo: 0.005 to 0.500 mass %, Nb: 0.0010 to 0.0100 mass %, Ta: 0.001 to 0.010 mass %, and Ti: 0.001 to 0.0100 mass %.

3. The method for producing a grain-oriented electrical steel sheet according to claim 2, wherein magnetic domain subdividing treatment is performed in any of the processes after the cold rolling by forming a groove on the surface of the steel sheet in a direction intersecting the rolling direction.

4. The method for producing a grain-oriented electrical steel sheet according to claim 2, wherein magnetic domain subdividing treatment is performed by irradiating an electron beam or a laser beam onto the surface of the steel sheet with the insulation coating formed thereon in a direction intersecting the rolling direction.

5. The method for producing a grain-oriented electrical steel sheet according to claim 1, wherein magnetic domain subdividing treatment is performed in any of the processes after the cold rolling by forming a groove on the surface of the steel sheet in a direction intersecting the rolling direction.

6. The method for producing a grain-oriented electrical steel sheet according to claim 1, wherein magnetic domain subdividing treatment is performed by irradiating an electron beam or a laser beam onto the surface of the steel sheet with the insulation coating formed thereon in a direction intersecting the rolling direction.

7. The method for producing a grain-oriented electrical steel sheet according to claim 1, wherein during the gradual heating from 860 to 970° C., the heating rate is maintained in a range of 0.5 to 4.0° C./hr.

* * * * *